US005613389A

United States Patent [19]

Häuser

[11] Patent Number: 5,613,389

[45] Date of Patent: Mar. 25, 1997

[54] LOCKING DEVICE CONSISTING OF A KEY AND A LOCK CYLINDER

[75] Inventor: Herbert Häuser, Elsdorf, Germany

[73] Assignee: DOM Sicherheitstechnik GmbH & Co. KG., Brühl, Germany

[21] Appl. No.: 236,628

[22] Filed: Apr. 29, 1994

[30] Foreign Application Priority Data

Apr. 30, 1993 [DE] Germany ..... 43 14 208.7

[51] Int. Cl.[6] ..... E05B 29/04

[52] U.S. Cl. ..... 70/366; 70/386; 70/409

[58] Field of Search ..... 70/365, 366, 409, 70/386, 377, 453, 492, 495, 496

[56] References Cited

U.S. PATENT DOCUMENTS

| | | | |
|---|---|---|---|
| 1,438,336 | 12/1922 | Schroeder | 70/453 |
| 2,007,142 | 7/1935 | Keil | 70/377 |
| 2,552,294 | 5/1951 | Patrignani | 70/492 X |
| 3,478,549 | 11/1969 | Schlage | 70/453 |
| 3,597,948 | 8/1971 | Johnstone | 70/453 X |
| 3,695,073 | 10/1972 | Prescott | 70/366 |
| 3,848,442 | 11/1974 | Mertanen | 70/366 |
| 4,008,588 | 2/1977 | Miller et al. | 70/366 |
| 4,267,717 | 5/1981 | Martikainen | 70/377 X |
| 4,407,147 | 10/1983 | Larson | 70/409 X |
| 4,512,166 | 4/1985 | Dunphy et al. | 70/369 X |
| 4,637,240 | 1/1987 | Nevalainen et al. | 70/377 X |
| 4,651,546 | 3/1987 | Evans | 70/377 X |
| 5,086,631 | 2/1992 | Agbay | 70/366 |

FOREIGN PATENT DOCUMENTS

| | | | |
|---|---|---|---|
| 25708 | 12/1952 | Finland | 70/366 |
| 2384922 | 11/1978 | France | 70/366 |
| 506575 | 7/1956 | Italy | 70/492 |
| 0575088 | 3/1958 | Italy | 70/366 |
| 417595 | 9/1974 | U.S.S.R. | 70/386 |
| 450017 | 4/1975 | U.S.S.R. | 70/366 |
| 2038401 | 7/1980 | United Kingdom | 70/366 |

*Primary Examiner*—Lloyd A. Gall
*Attorney, Agent, or Firm*—Spencer T. Smith

[57] ABSTRACT

The locking device consists of a key (2) and a lock cylinder (1), with a cylinder core (5) which is rotatable in a casing (3) and has an axially extending channel (16) for insertion of a key (2) which passes through plate-shaped tumblers (7) arranged axially in succession so as to be displaceable in the cylinder core (5) and, with bit stages provided on the key shank (13), locates these tumblers (7) in a position releasing the rotation of the cylinder core (5). The locating displacement movement of the tumbler plates (7) is designed as a rotational movement around the axis of the key shank (13), and its range is preferably limited by stops (21, 22).

2 Claims, 9 Drawing Sheets

LOCKING DEVICE CONSISTING OF A KEY AND A LOCK CYLINDER

BACKGROUND OF THE INVENTION

The invention relates to a locking device consisting of a key and a lock cylinder, with a cylinder core which is rotatable in a casing and has an axially extending channel for insertion of a key which passes through plate-shaped tumblers arranged axially in succession so as to be displaceable in the cylinder core and, with bit stages provided on the key shank, locates these tumblers in a position in which the cylinder core can rotate.

Many locking devices of this type are known. The plate-shaped tumblers are spring-loaded in the direction of their engagement position and, with their blocking ends, enter associated longitudinal grooves of the cylinder casing in the key removal position. By insertion of the associated key which has the bit stages designed in the form of closing notches on its narrow sides, the tumbler plates are located in the cylinder core by longitudinal displacement such that the blocking ends leave the grooves of the cylinder casing. The cylinder core can then be rotated by means of the key.

It is an object of the present invention to provide a locking device of this type which is simple to produce such that the tumbler plates may be located without longitudinal displacement thereof, that is transversely to the longitudinal direction of the cylinder core.

BRIEF SUMMARY OF THE INVENTION

The present invention provides a locking device consisting of a key and a lock cylinder, with a cylinder core which is rotatable in a casing and has an axially extending channel for insertion of a key which passes through plate-shaped tumblers arranged axially in succession so as to be displaceable in the cylinder core and, with bit stages provided on the key shank, locates these tumblers in a position releasing the rotation of the cylinder core characterised in that the locating displacement movement of the tumbler plates is designed as a rotational movement around the axis of the key shank and its range is preferably limited by stops.

This design produces a locking device which is distinguished, on the one hand, by a simple construction and, on the other hand, by an improved method of locking. The tumbler plates are accordingly designed as rotating discs and are brought, by insertion of the appropriate key, into a position which allows subsequent rotation of the cylinder core. The rotatable design of the tumbler plates leads to low bearing friction. Furthermore, the tumbler plates may be stable in design so that greater forces may also be absorbed without damage. Moreover, it is not necessary to provide the disc-shaped tumbler plates with compression springs which load them. The construction of the locking device is therefore simpler. No spring forces have to be overcome during key insertion/removal displacement either. Finally, production is simplified as the locking device may be assembled overall with fewer components.

In a preferred embodiment, the range of displacement of the rotational angle of the individual tumbler plates is limited by stops. Therefore, the tumbler plates can never leave their functional position. The stops ensure that the tumbler plates can be grasped and controlled by the key in the prescribed manner. For example, the stops may be achieved by means of a curved slot of which the edges form the stops in conjunction with a stop strip arranged in the cylinder core.

It should also be emphasised that each tumbler plate has at least one recess provided at its periphery such that, in the case of located tumbler plates, these recesses form a blocking strip entry space which extends parallel to a blocking strip in such a way that the blocking strip releases the rotation of the cylinder core. When the tumbler plates are not located by the key, the locking strip extends both in the cylinder casing and in the cylinder core and prevents rotation of the cylinder core. The blocking strip cannot escape as the peripheral recesses do not form an entry space for the blocking strip. The blocking strip can only escape when the tumblers are located by the prescribed key. The successive recesses are then aligned and form a continuous entry space for the blocking strip so that the blocking strip can leave the cylinder casing and is subsequently entrained during rotational movement of the cylinder core. A rod of circular cross section is particularly recommended for the blocking strip and affords the advantage of inexpensive production.

A particularly smooth method of locking with low forces may be achieved if a ball cage plate with inserted balls projecting over both broad sides is provided between each two tumbler plates. The balls are arranged in the ball cage plates such that they project beyond the broad sides thereof but do not leave the ball cage plates. This has proven particularly desirable during assembly of the lock cylinder.

The feature whereby the key shank penetration orifice of the tumbler plate and the cross section of the key shank have substantially semicircular basic shapes and the secant-shaped base of the key shank is the carrier of the bit stages of the key is beneficial in terms of production and in terms of strength. This feature has proven particularly advantageous during key production as a round profile may be used as a basis for manufacture thereof. Therefore, the key shank is also particularly strong. On the other hand, the key shank penetration orifices may be produced, for example, by stamping.

It should be emphasised that the key shank, opposite the base, has a longitudinal groove for the entry of a centering projection protruding into the key channel. The key is guided by the centering projection during insertion of the key. The tumbler plates are therefore appropriately grasped and correctly located. The centering projection, in conjunction with the longitudinal groove, then provides the coupling between the key and the cylinder core during a rotational displacement thereof.

With respect to the design of the key, it has proven particularly desirable that the bit stages of the key form undulating lines which extend differently on one base longitudinal edge than on the other base longitudinal edge. The undulating lines are produced by a different angular trend relative to the secant-shaped base of the key shank.

The undulating lines are designed such that the undulating line indentations are smallest on the longitudinal center line of the base. To allow the key to be inserted and removed despite the mutually adjacent bit stages which have a different inclination from each other, the vertices of the bit stage undulating lines are staggered on one base longitudinal edge relative to the other base longitudinal edge, and the undulating indentations fall and rise transversely to the longitudinal direction of the key to the respective opposing base longitudinal edge. Obliquely extending transition zones are thus produced between adjacent bit stages so that the key may be pushed from one bit stage to another, the tumbler plates each receiving a certain degree of rotation.

Finally, according to a further advantageous feature, the key channel has a circular cross section and the secant line of the key shank penetration orifice intersects the cross section of the key channel. On the one hand, the key shank is optimally guided through the key channel. On the other hand, it is guaranteed to pass into the region of the secant lines of the key shank penetration orifices in the prescribed manner so as to control the tumbler plates. When the key is removed, all secant lines of the tumbler plates are aligned with one another. It cannot be seen from the exterior how the tumbler plates have to be rotated to allow opening. This measure has proven to be particularly resistant to scanning.

BRIEF DESCRIPTION OF THE DRAWINGS

FIG. 7 is the section along line VII—VII in FIG. 6;

DETAILED DESCRIPTION

Figure 1:
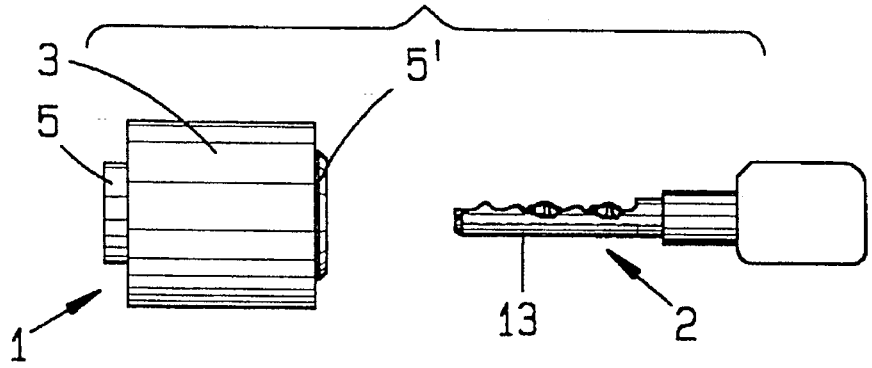
FIG. 1 is a view of a locking device consisting of a lock cylinder and a key.

The locking device illustrated comprises a lock cylinder 1 and an associated key 2. The lock cylinder 1 has a cylinder casing 3 which is annular in cross section and rotatably supports a cylinder core 5 of suitable diameter in its central casing bore 4. The head 5' of the cylinder core 5 on the key insertion side is greater in diameter and projects partially into a staged bore 4' adjoining the casing bore 4. In this way, the cylinder core 5 is secured against axial displacement in one direction. A snap ring, not shown, covering the inner end of the cylinder core, for example, provides security in the other direction.

Figure 12:
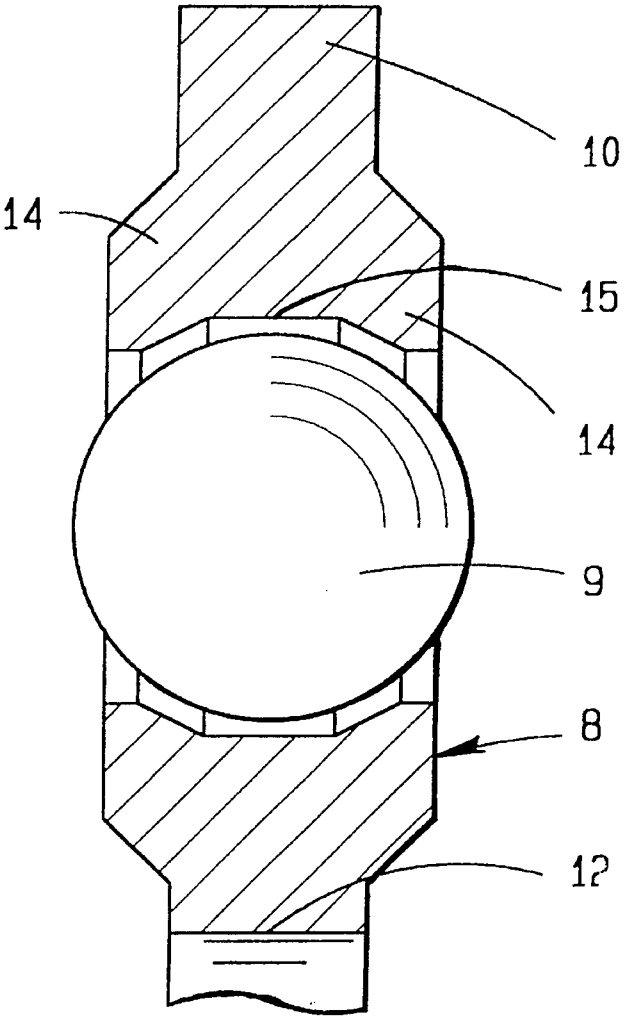
FIG. 12 is a greatly enlarged section through the ball cage plate in the region of an inserted ball and FIG. 13 is a perspective illustration of the key shank forming the bit stages.
Figure 11:
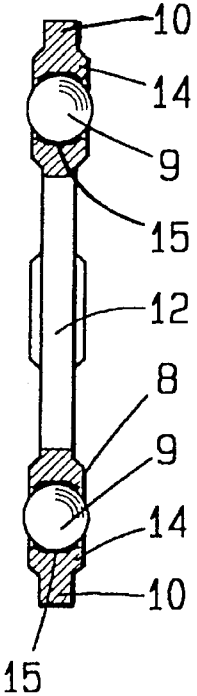
FIG. 11 is a section through the ball cage plate.
Figure 10:
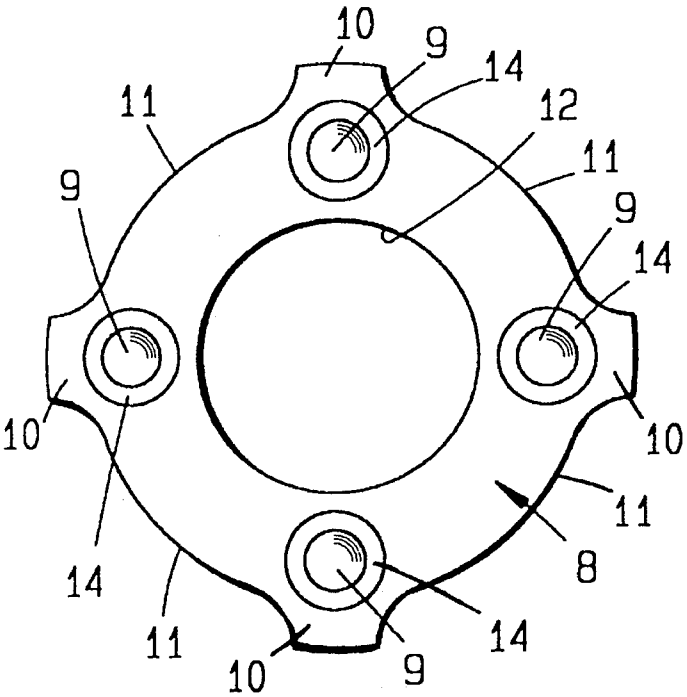
FIG. 10 is a detailed view of a ball cage plate.

A bore 6 which ends just in front of the staged bore 4' when the cylinder core is installed issues from the inner end of the cylinder core 5. The bore 6 serves to receive tumbler plates 7 which are arranged in succession in the axial direction of the cylinder core 5 and are designed as rotatable discs. The broad faces of the tumbler plates are ball mounted relative to one another. This is effected such that a ball cage plate 8 with inserted balls 9 projecting over both broad sides extends between each two tumbler plates 7. FIGS. 10 to 12 show a detailed view of the ball cage plates 8. The ball cage plates 8 are annular in design. The annular shape has four bearing lugs 10 arranged uniformly around the periphery. The external edges of each two opposing bearing lugs 10, extending concentrically to the center line, slide on the internal wall of the bore 6 of the cylinder core 5. Reliefs 11 running externally in the form of an arc extend between the lugs 10. Each ball cage plate 8 has a central through-orifice 12 for the shank 13 of the key 2. In the region of the lugs 10, each ball cage plate 8 forms crown-shaped thickened regions 14 projecting beyond the two broad sides. A cage bore 15 for receiving a respective ball 9 is located in the region of two thickened areas 14 opposing one another on the same axis. The cage bores 15 have reduced cross sections in the direction of the broad sides, allowing a certain degree of displacement for the balls in the longitudinal direction of the cylinder core 5. However, the balls 9 cannot fall from the cage bores 15.

From the head 5' of the cylinder core 5 there issues a key channel 16 having a circular cross section. The diameter of the key channel 16 is adapted to that of the key shank 13. A centering projection 17 of the cylinder core 5 penetrates into the clear cross section of the key channel 16, the key shank 13 forming a longitudinal groove 18 for the centering projection 17. A supporting projection 19 extends opposite the centering projection 17. The supporting projection 19 is somewhat wider in size than the centering projection 17 so that the key can be inserted into the key channel 16 in only one position. The key shank has a cross section with a substantially semicircular basic shape. In the embodiment, the cross section is somewhat larger than a semicircular cross section. The supporting projection 19 acts in conjunction with the secant-shaped base 20 as an abutment for the inserted key.

The range of displacement of the rotational angle of the individual tumbler plates 7 is limited by stops 21, 22. The stops 21, 22 are formed by the end regions of a marginal curved slot 23. A stop strip 24 penetrates into the curved slot 23. The stop strip 24 is held by a longitudinal aperture 25 penetrating the wall of the cylinder core 5. The longitudinal aperture 25 extends over the region of the tumbler plates 7. An outwardly directed radial displacement of the stop strip 24 is prevented by the internal wall of the casing bore 4. In the other direction, the stop strip 24 cannot be radially displaced through the bottom of the curved slots 23, cf. in particular FIG. 5. Furthermore, the longitudinal aperture 25 and the stop strip inserted therein extend over the longitudinal plane of the cylinder core 5 situated through the centering projection 17 and supporting projection 19. In the embodiment, each tumbler plate 7 has three recesses 26, 27, 28 which are provided around the periphery and, as described hereinafter, co-operate with blocking strips 29, 30, 31 allocated to them. When the key 2 is removed, cf. in particular FIG. 5, the blocking strips 29 to 31 lie with a portion of their periphery in longitudinally directed grooves 32, 33, 34 of the cylinder casing 3. With the remainder of their periphery, the blocking strips 29, 30, 31 enter longitudinal niches 35, 36, 37 in the cylinder core 5 or its wall. When the key is removed, the tumbler plates 7 act as an abutment against a radial inward displacement of the blocking strips 29, 30, 31. Therefore, the cylinder core 5 cannot be rotated within the casing bore 4.

Figure 5:
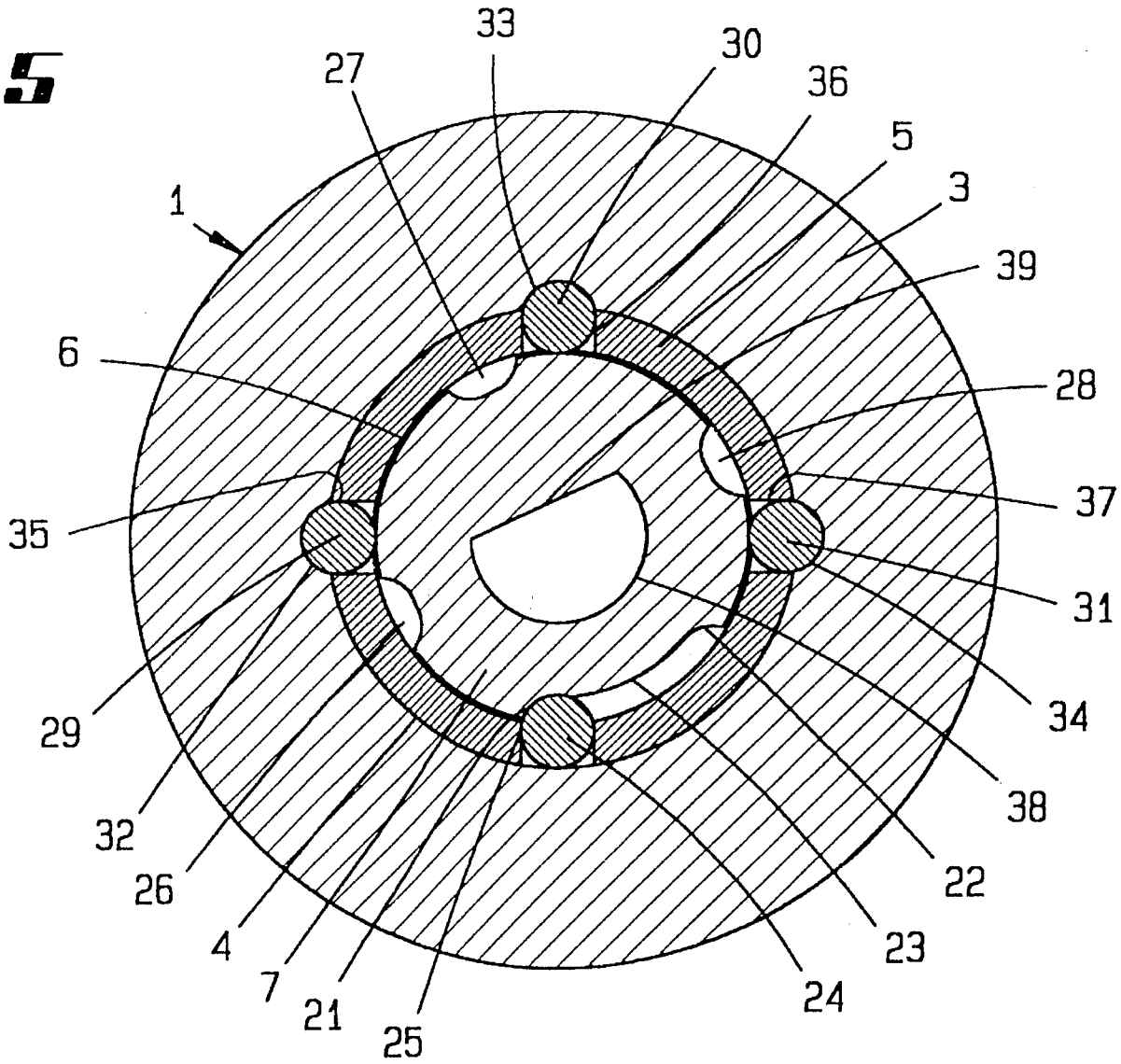
FIG. 5 is the section along line V—V in FIG. 4.

As shown in FIG. 5, the longitudinal aperture 25 as well as the longitudinal niches 35, 36, 37 are distributed at angles on the cylinder core 5. The stop 21 of the tumbler plate 7 also rests on the stop strip 24 when the key 2 is removed.

Figure 4:
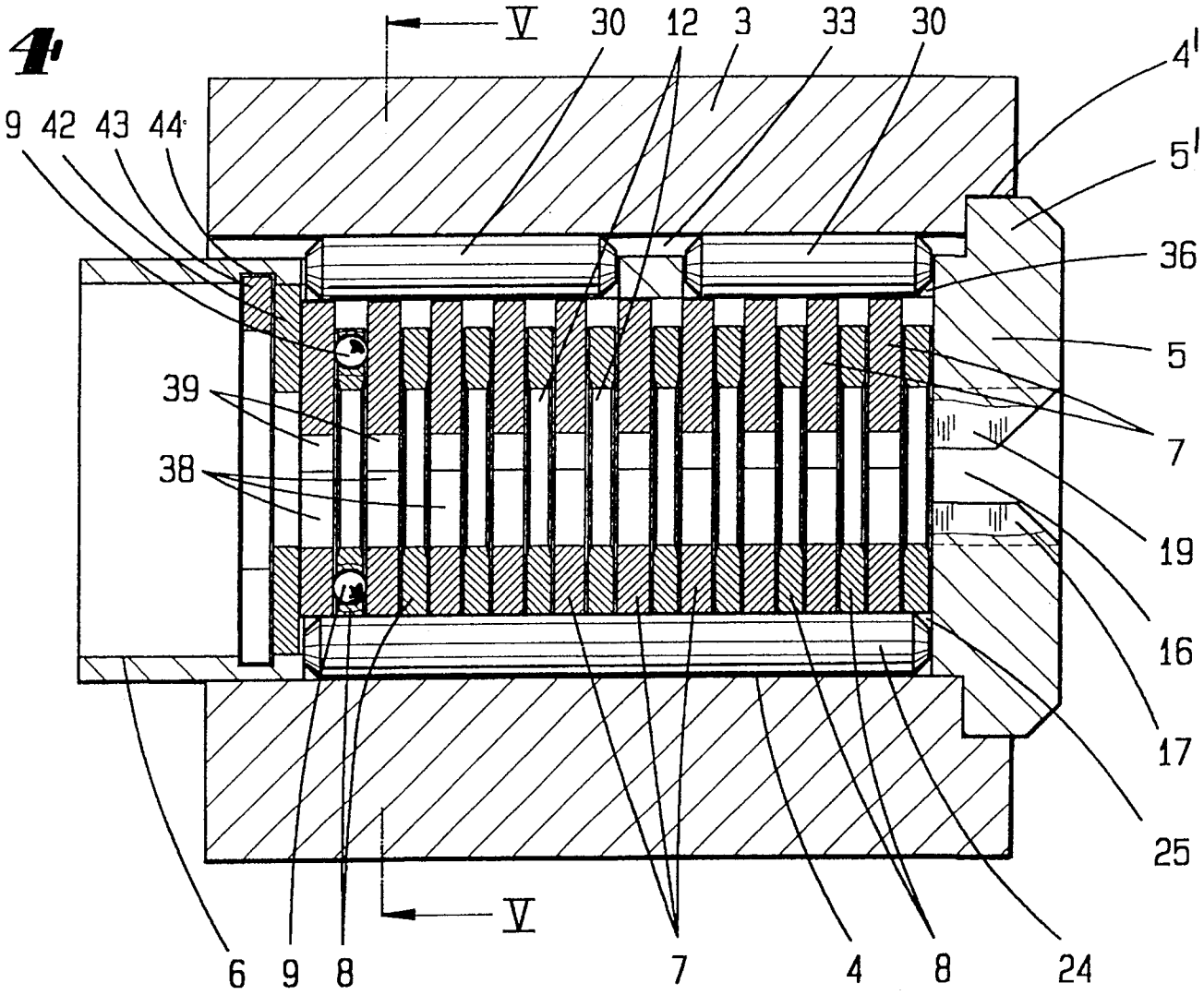
FIG. 4 is a longitudinal section, also enlarged, through the lock cylinder with the key removed.

The blocking strips 29, 30, 31 can then have different lengths. Each blocking strip may be composed of two successive block strip portions, as shown in particular in FIGS. 4 and 6.

A central key shank penetration orifice 38 is located in each tumbler plate 7. This orifice 38 also has a substantially semicircular basic shape in accordance with the cross section of the key shank 13, forming a secant line 39. The secant line 39 co-operates with bit stages 40 of the key 2. Specific tumbler plates 7 differ from one another in that the secant lines 39 are orientated at different rotational angles relative to the recesses 26, 27, 28. Interconnecting the bit stages 40 are control ramps 41, which form with the bit stages, an undulating surface. The undulating line extending along edge K1 is labeled L1 and the line extending along edge K2 is labeled L2. The locations of the verticles along line L1 are identified S1 and the locations of the verticles along line L2 are identified S2.

Figure 2:
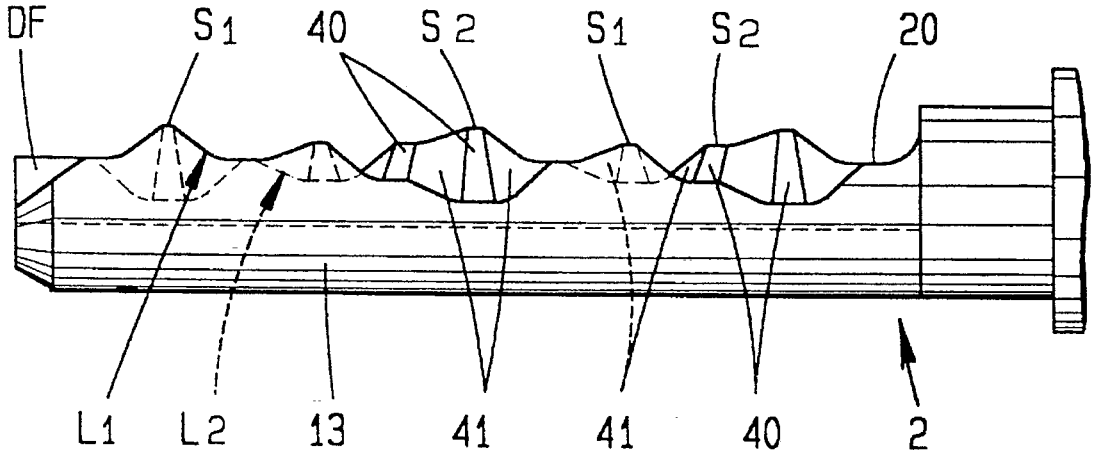
FIG. 2 is a detailed enlarged view of the key shank.
Figure 3:
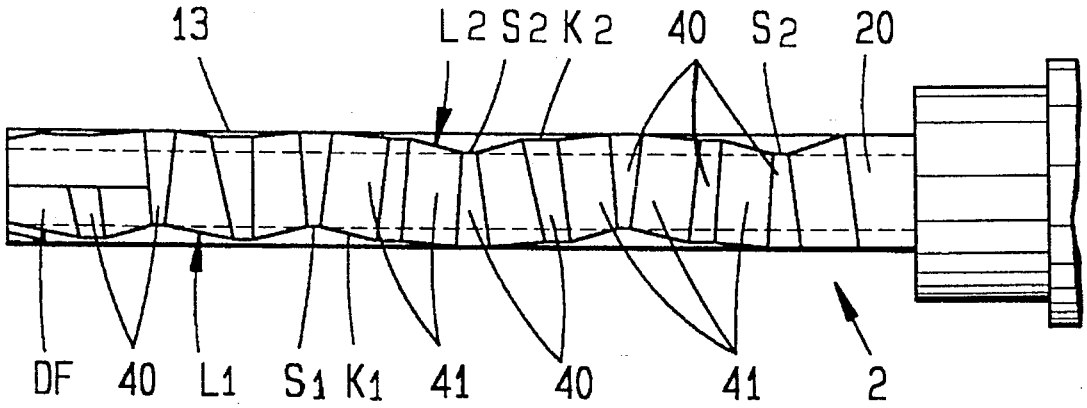
FIG. 3 is a plan view of the key shank having the bit stages.
Figure 13:
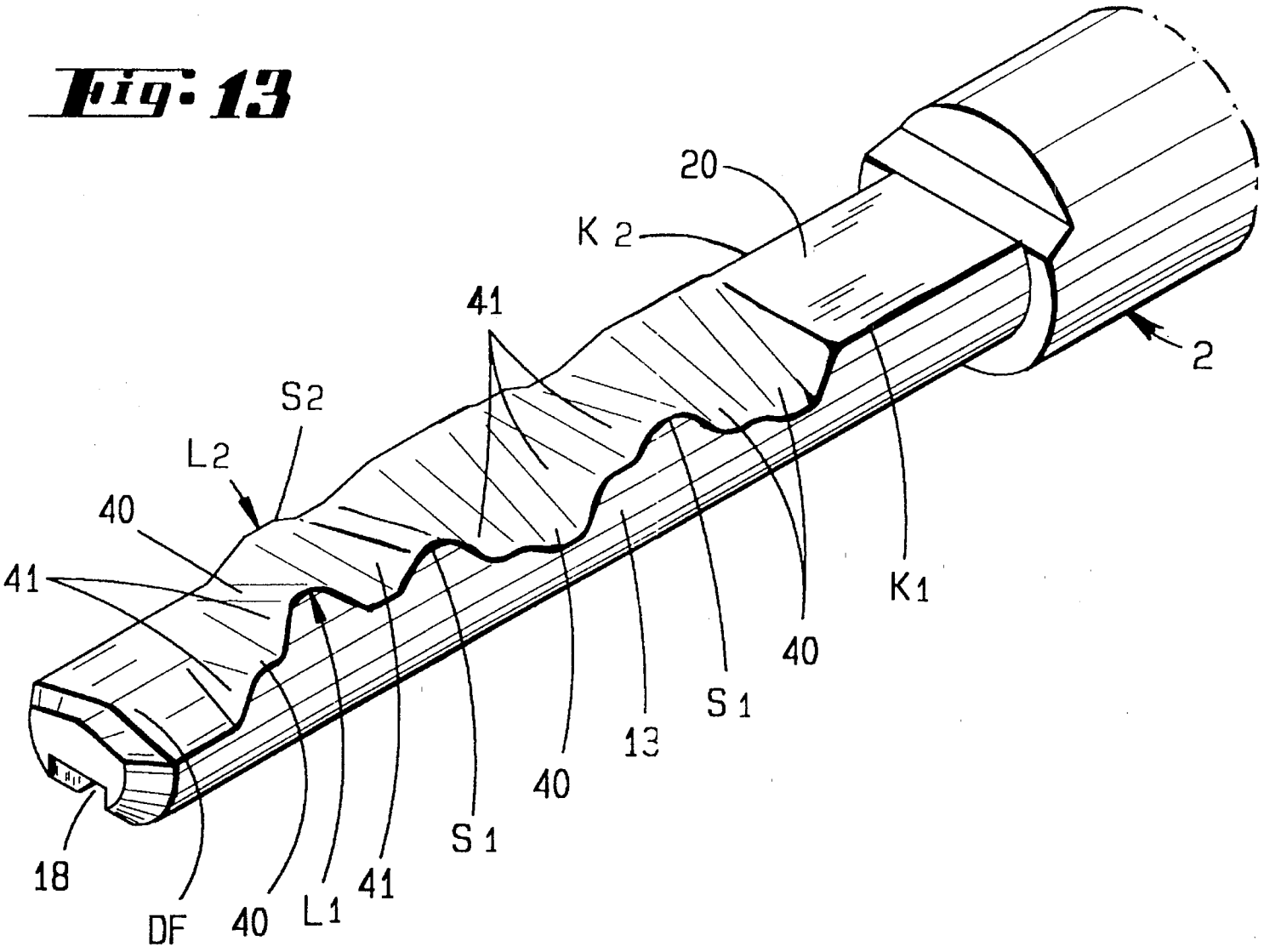

FIGS. 2 and 13 also show clearly that the vertices S1 of the bit stage undulating lines L1 on one base longitudinal edge K1 are staggered relative to the vertices S2 of the other base longitudinal edge K2. The undulations can fall or rise toward mutually opposed base longitudinal edges.

The unit consisting of tumbler plates 7 and ball cage plates 8 is secured against axial displacement within the cylinder 5 at the rear by a disc 42 resting on a securing ring 43. The securing ring 43 rests in an annular groove 44 in the bore 6.

Figure 6:
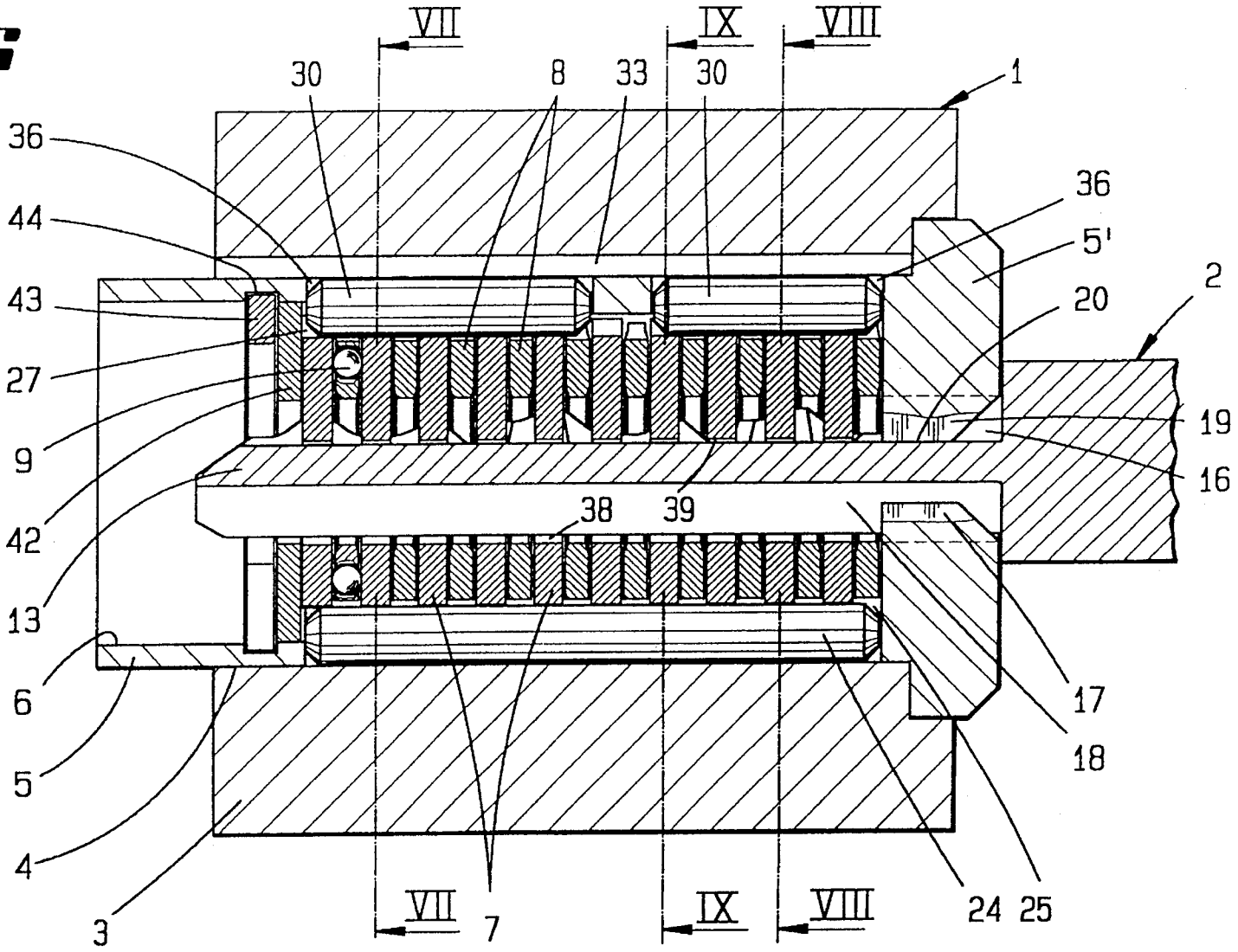
FIG. 6 is an illustration corresponding to FIG. 4 but with the key inserted.
Figure 1:
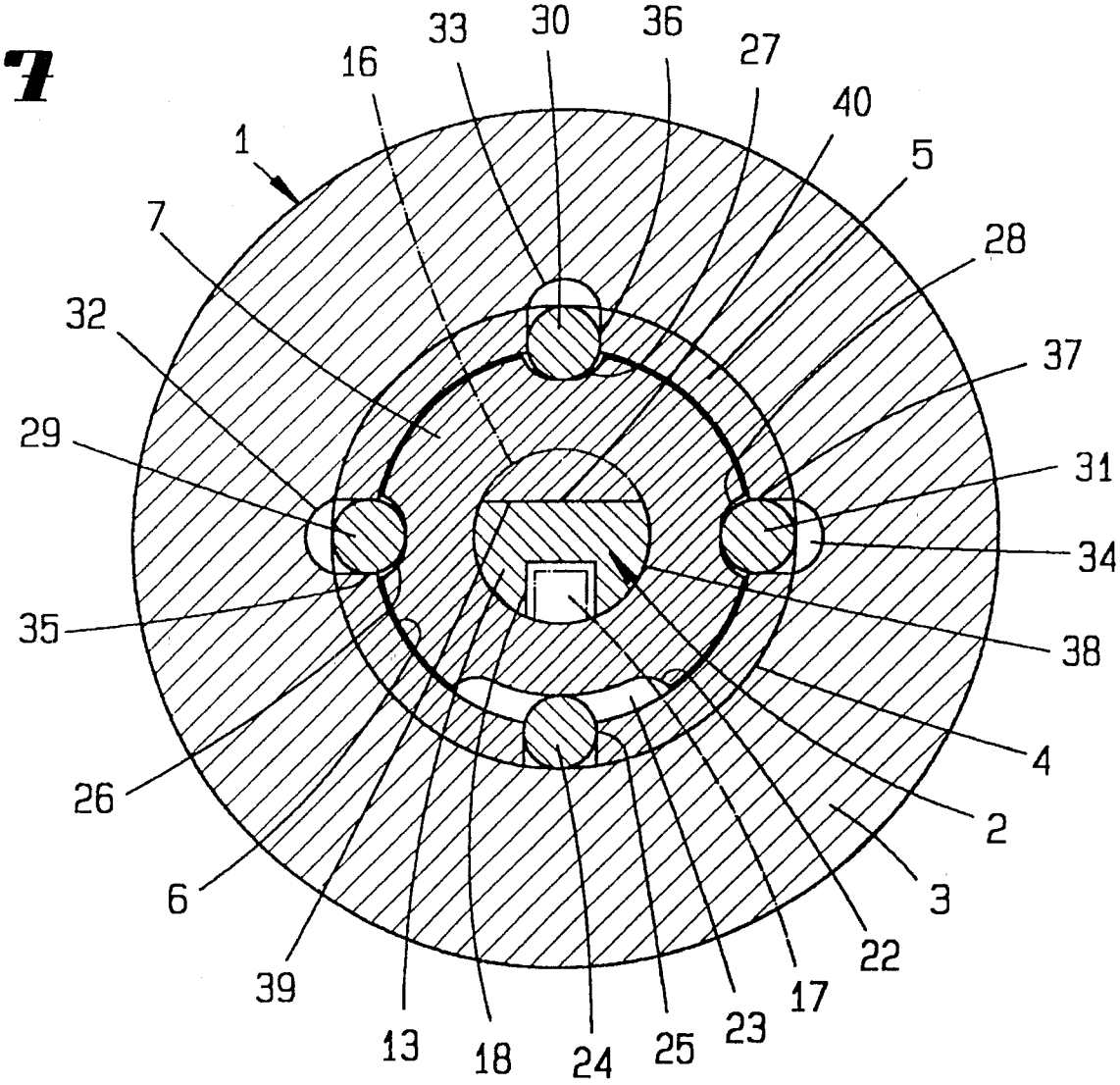
Figure 8:
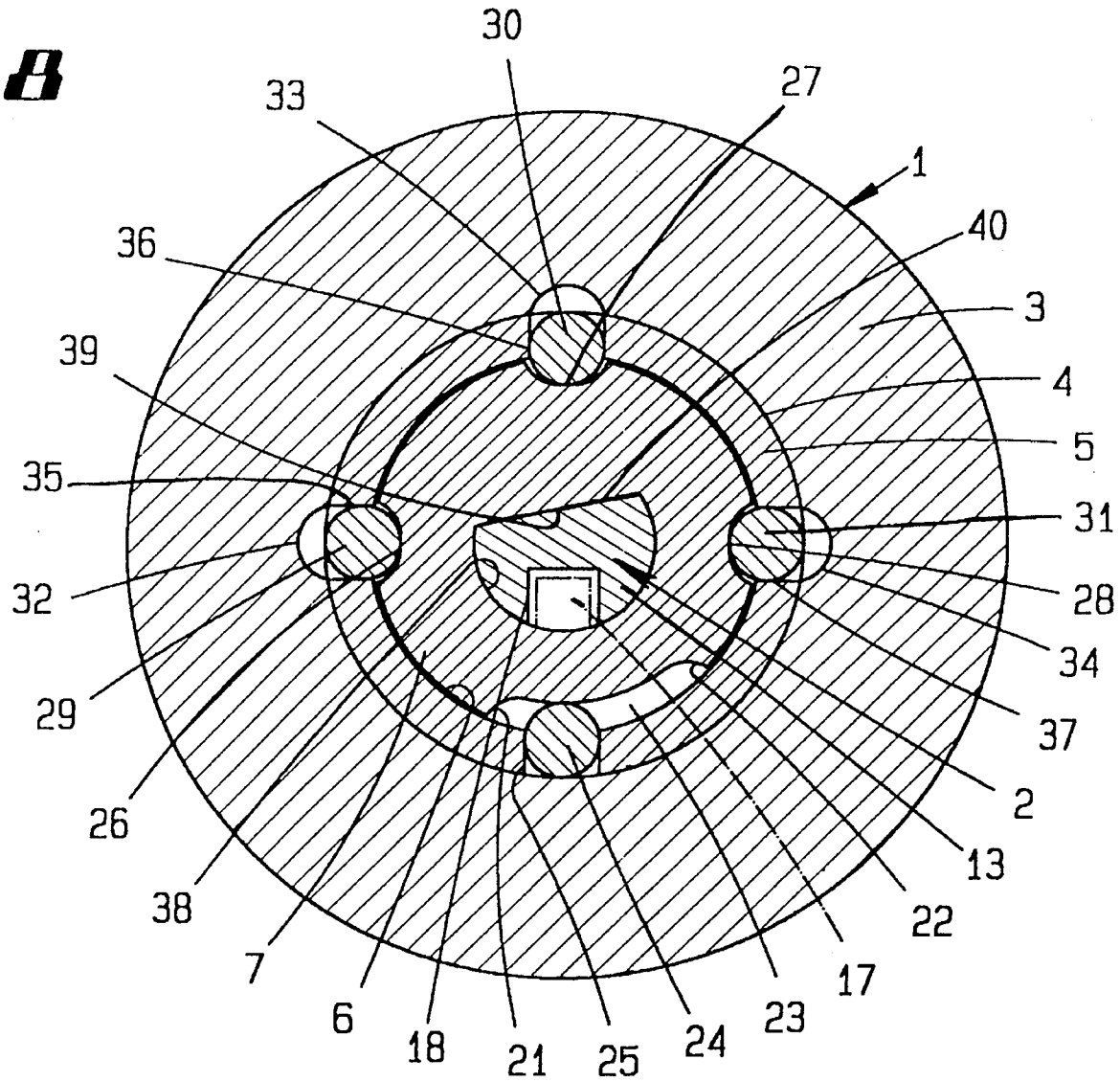
FIG. 8 is the section along line VIII—VIII in FIG. 6.
Figure 9:
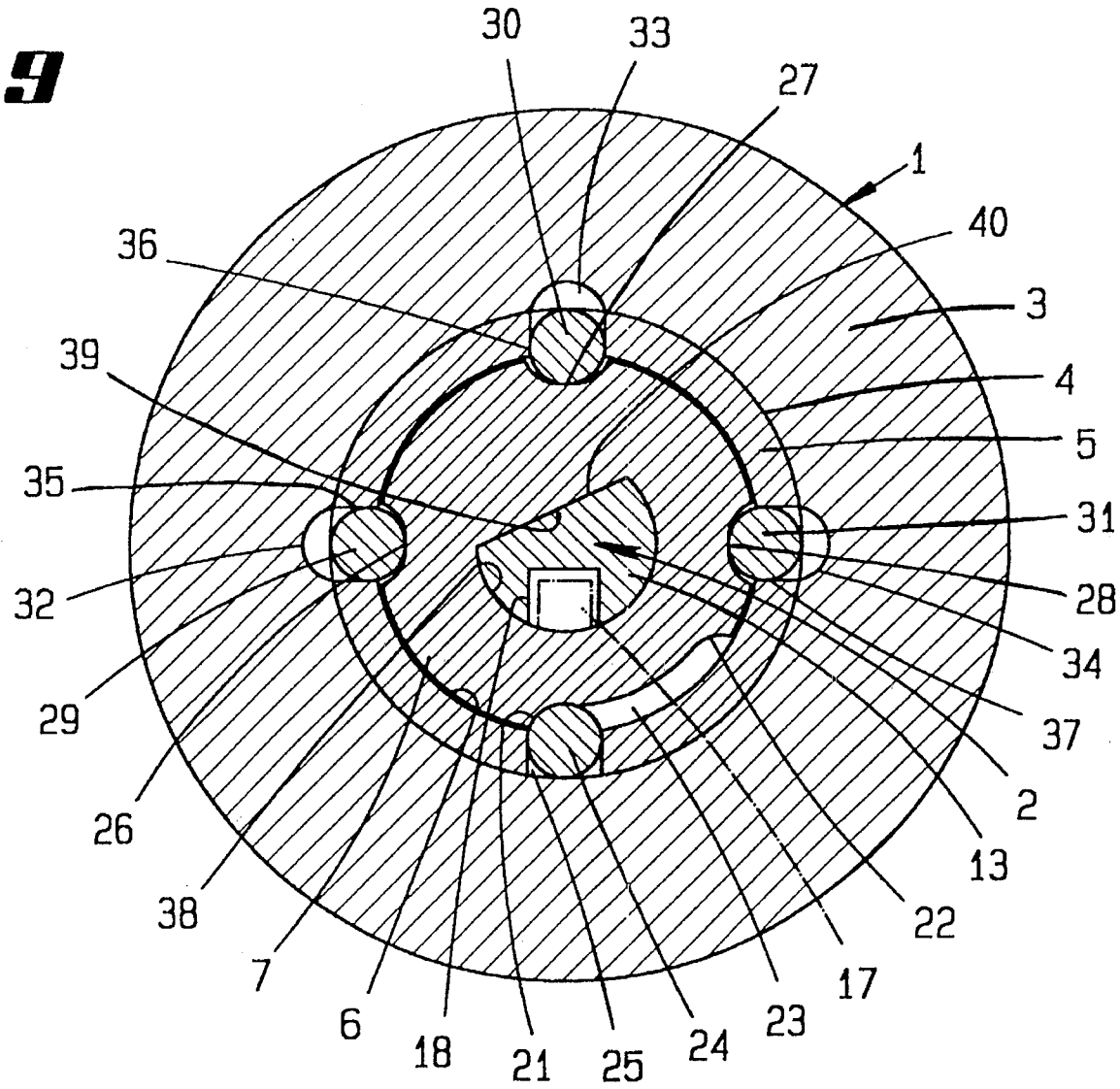
FIG. 9 is the section along line IX—IX in FIG. 6.

The following mode of operation takes place:

When the key 2 is removed, the secant line 39 of the key shank through orifice 38 intersects the cross section of the key channel 16, more specifically at a predetermined angle as already mentioned. The secant-shaped bases 39 of all tumbler plates 7 are then aligned with one another. If the prescribed key 2 is now inserted into the key channel 16, the tumbler plates 7 are rotatably displaced by the bit stages 40 and the control ramps 41 extending between them. The insertion of the key 2 is simplified by an obtuse angled roof shape DF in the region in front of the first two bit stages 40. FIG. 6 shows the completely inserted position of the key. All tumbler plates 7, cf. FIGS. 7, 8 and 9, have then been rotated such that the recesses 26, 27, 28 are aligned with the blocking strips 29, 30, 31 and form entry spaces extending parallel to the blocking strips. Inward control of the blocking strips 29, 30, 31 in the radial direction takes place during the subsequent closing rotation, the blocking strips then dipping into the recesses 26, 27, 28 and no longer projecting into the core wall. The cylinder core 5 is therefore freely rotatable by means of the key.

After the closing process has been carried out, the key 2 may be removed again when the cylinder core 5 is rotated back into the starting position. The corresponding position may be made recognizable, for example, by a catch. An optical display is also possible. During removal of the key 2, the tumbler plates 7 are rotated by the bit stages 40 and the control ramps 41 such that they return to a position according to FIG. 5 in which all secant lines 39 of all tumbler plates 7 are aligned with one another.

The features of the invention disclosed in the foregoing description, the drawings and the claims may be important for carrying out the invention both individually and in any combination. All disclosed features are essential to the invention. The disclosure of the application includes the full content of the associated/accompanying priority documents (copy of the preliminary application).

I claim:

1. A key operated cylindrical lock comprising a selected number of cylindrical tumbler plates, a cylindrical core for rotatably supporting said cylindrical tumbler plates, and a ball cage plate assembly intermediate each adjacent pair of cylindrical tumbler plates, each assembly including a ball cage plate and a plurality of balls, said ball cage plates having an orifice for receiving a key therein and having a corresponding plurality of cage bores for receiving said plurality of balls, each of said bores which receive said balls being radially spaced from said orifice, said balls being selectively sized so that tumbler plates will be engaged by said balls.

2. A key operated cylindrical lock according to claim 1, wherein said plurality is four.

* * * * *